US011850871B2

(12) United States Patent
Ishikawa et al.

(10) Patent No.: US 11,850,871 B2
(45) Date of Patent: Dec. 26, 2023

(54) MOBILE PRINTER

(71) Applicant: TOSHIBA TEC KABUSHIKI KAISHA, Tokyo (JP)

(72) Inventors: Daisuke Ishikawa, Mishima Shizuoka (JP); Taishi Fukazawa, Chofu Tokyo (JP); Hiroshi Kiyomoto, Hiratsuka Kanagawa (JP); Maiko Miyoshi, Izunokuni Shizuoka (JP); Yui Hiyoshi, Mishima Shizuoka (JP); Takaya Kitawaki, Mishima Shizuoka (JP); Seiya Shimizu, Numazu Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/528,693

(22) Filed: Nov. 17, 2021

(65) Prior Publication Data

US 2022/0234364 A1 Jul. 28, 2022

(30) Foreign Application Priority Data

Jan. 25, 2021 (JP) ..... 2021-009787

(51) Int. Cl.

| | |
|---|---|
| ***B41J 3/36*** | (2006.01) |
| ***B41J 3/39*** | (2006.01) |
| ***B41J 2/21*** | (2006.01) |
| ***B41J 29/02*** | (2006.01) |
| ***B41J 29/38*** | (2006.01) |

(52) U.S. Cl.

CPC ..... *B41J 3/36* (2013.01); *B41J 2/2103* (2013.01); *B41J 3/39* (2013.01); *B41J 29/02* (2013.01); *B41J 29/38* (2013.01)

(58) Field of Classification Search

CPC ..... B41J 3/36; B41J 3/39; B41J 3/4075

See application file for complete search history.

(56) References Cited

U.S. PATENT DOCUMENTS 6,039,431 A 3/2000 Yui et al.
6,092,947 A * 7/2000 Nunokawa ..... B41J 11/26 400/615.2

(Continued)

FOREIGN PATENT DOCUMENTS

DE 10016412 A1 10/2001
JP 2996581 B2 * 1/2000 ..... B41M 7/0009

(Continued)

OTHER PUBLICATIONS

Saito, Machine TranslationofJP-2013212616-A, 2013 (Year: 2013).*

(Continued)

*Primary Examiner* — Scott A Richmond
(74) *Attorney, Agent, or Firm* — Kim & Stewart LLP

(57) ABSTRACT

According to one embodiment, a mobile printer includes a first housing, a second housing, a hinge, and a print head. The first housing has a first surface on which a printing medium can be disposed. The second housing faces the first surface. The hinge connects the first housing and the second housing and permits the first and second housings to rotate relative to each other. The print head is provided in the second housing and is configured to print an image by discharging on to the print medium when the print medium is on the first surface between the first and second housings.

20 Claims, 4 Drawing Sheets

(56) References Cited

U.S. PATENT DOCUMENTS

| | | | | |
|---|---|---|---|---|
| 6,999,206 | B2 | 2/2006 | Silverbrook | |
| 2001/0024585 | A1* | 9/2001 | Koakutsu | G06F 3/1204 400/76 |
| 2014/0092179 | A1 | 4/2014 | Tamaki | |
| 2016/0059598 | A1* | 3/2016 | Koshigoe | B32B 1/02 347/222 |
| 2016/0350624 | A1* | 12/2016 | Liguori | H04N 1/00307 |
| 2017/0028747 | A1* | 2/2017 | Kanda | B41J 3/4075 |
| 2018/0029389 | A1* | 2/2018 | Ando | B41J 15/02 |
| 2019/0184708 | A1 | 6/2019 | Yamamoto | |
| 2020/0070551 | A1* | 3/2020 | Van Aerde | B41J 3/4075 |
| 2021/0291564 | A1* | 9/2021 | Sridhara | B41J 11/42 |
| 2022/0242145 | A1* | 8/2022 | Ukai | B41J 29/13 |

FOREIGN PATENT DOCUMENTS

| | | | | | |
|---|---|---|---|---|---|
| JP | 2001177703 | A | | 6/2001 | |
| JP | 2005081546 | A | | 3/2005 | |
| JP | 2013212616 | A | * | 10/2013 | |
| JP | 2016124166 | A | | 7/2016 | |
| JP | 2021066111 | A | * | 4/2021 | B41J 11/04 |
| KR | 20070073422 | A | | 7/2007 | |
| KR | 20170101075 | A | * | 9/2017 | |

OTHER PUBLICATIONS

Ukai, Machine Translation of JP-2021066111-A, 2021 (Year: 2021).*
Jang, Machine Translation of KR-20170101075-A, 2017 (Year: 2017).*
Saito, Machine Translation of JP-2996581-B2, 2000 (Year: 2000).*
U.S. Appl. No. 17/239,203, filed Apr. 23, 2021.
Extended European Search Report dated Jun. 2, 2022, mailed in counterpart European Application No. 21217183.9, 11 pages.

* cited by examiner

MOBILE PRINTER

CROSS-REFERENCE TO RELATED APPLICATION

This application is based upon and claims the benefit of priority from Japanese Patent Application No. 2021-009787, filed Jan. 25, 2021, the entire contents of which are incorporated herein by reference.

FIELD

Embodiments described herein relate generally to a mobile printer.

BACKGROUND

In the related art, a type of mobile printer is known that can print an image while being moved by a user relative to a printing medium, such as a sheet of paper or other printable surface. For example, when performing printing on the printing medium with such a mobile printer, the printing medium is placed on a flat surface, and then the mobile printer is pressed against the printing medium and moved across the surface of the printing medium.

However, if there is no flat surface readily available, or if the printing medium is attached to something (or is something) that cannot be placed on a flat surface, then printing with such a mobile printer may not be possible. Likewise, if the printing medium is hard and does not bend to conform to an underlying flat surface, then it may not be possible to press the mobile printer against the printing medium in the manner necessary to permit printing. Similarly, if the printing medium comprises a material, such as some types of paper, that will be noticeably deformed when force is applied, it can be difficult to perform the printing because the printing medium can be deformed into a non-flat shape at the point of contact with the mobile printer.

DETAILED DESCRIPTION

In general, according to one embodiment, a mobile printer includes a first housing, a second housing, a hinge, and a print head. The first housing has a first surface. The second housing is configured to face the first surface of the first housing. The hinge connects the first housing and the second housing and is configured to permit the first housing and the second housing to rotate relative to each other. The print head in the second housing is configured to print an image on to a print medium on the first surface by discharging ink.

Hereinafter, certain example embodiments of a mobile printer will be described with reference to the drawings. The drawings are not necessarily to scale, and various changes, alterations, and modifications may be made to the depicted examples without departing from the scope of the present disclosure.

Figure 1:
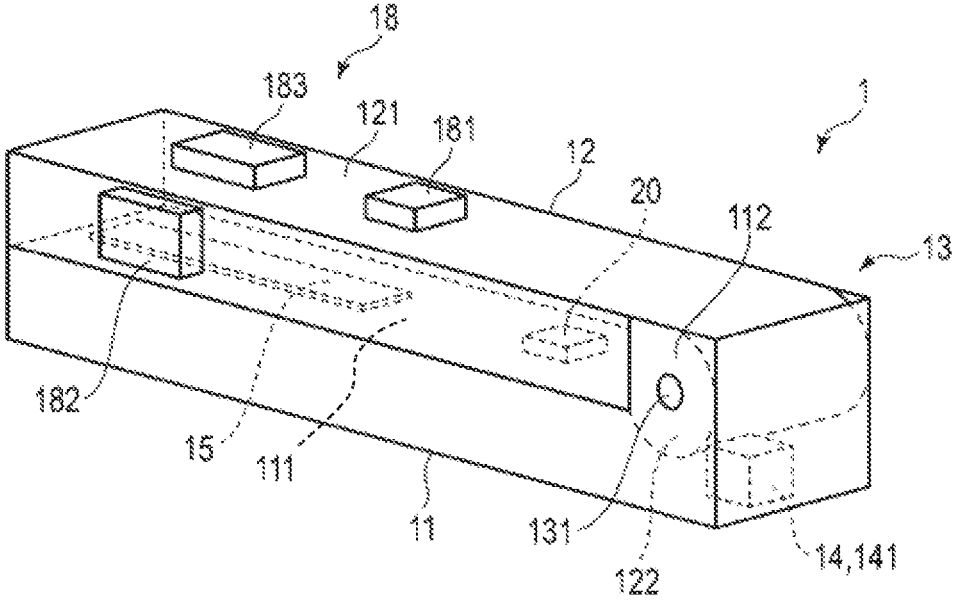
FIG. 1 is a perspective view schematically illustrating aspects of a mobile printer according to an embodiment.
Figure 2:
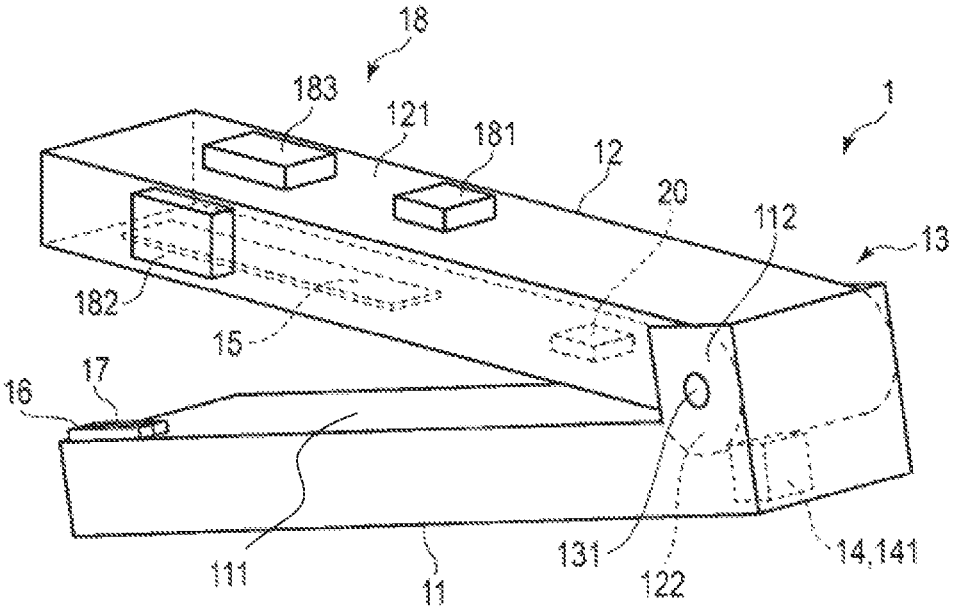
FIG. 2 is a perspective view schematically illustrating additional aspects of a mobile printer according to an embodiment.
Figure 3:
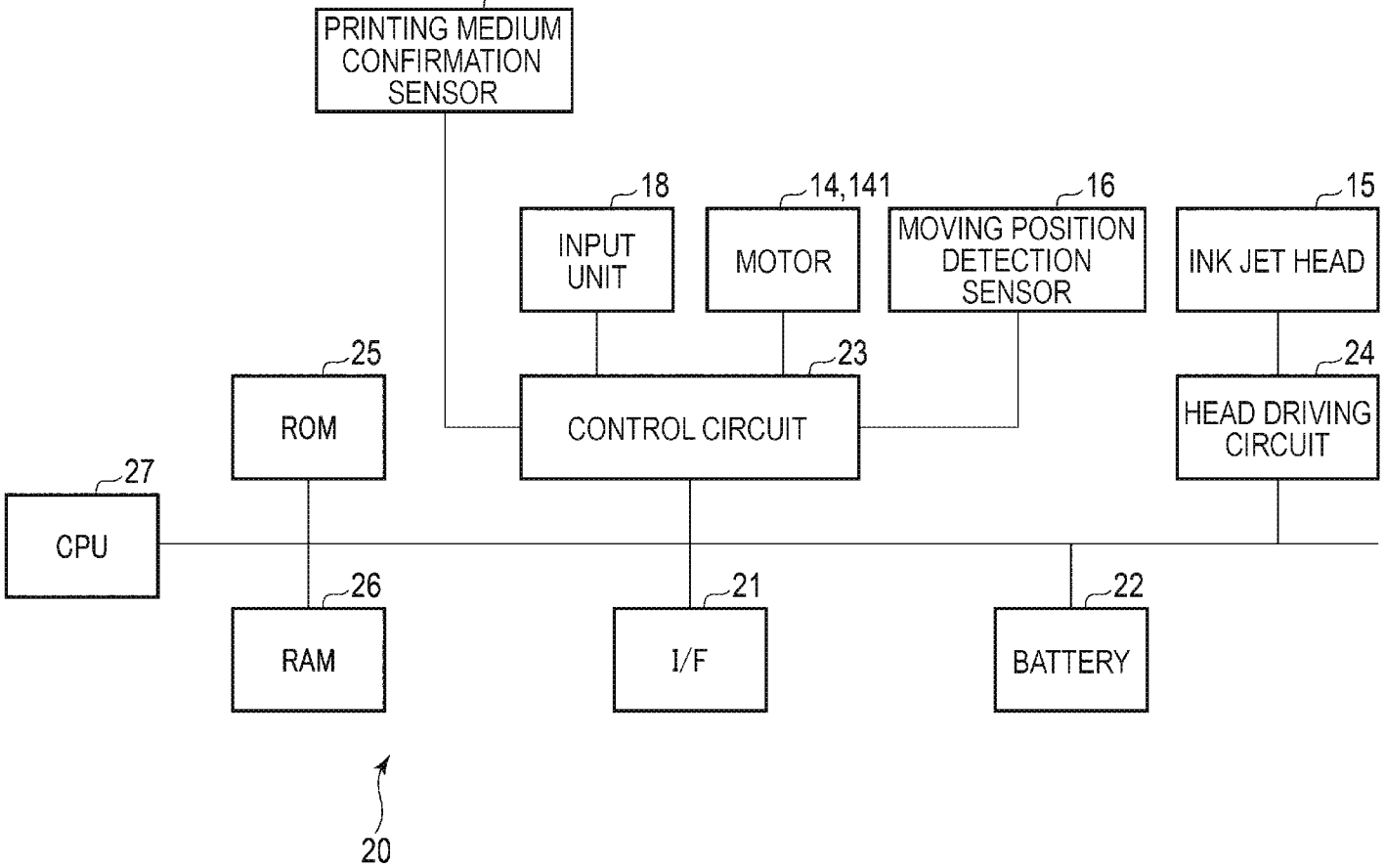
FIG. 3 is a block diagram illustrating a configuration of a mobile printer according to an embodiment.

FIGS. 1 and 2 are perspective views schematically illustrating a configuration of the mobile printer 1 according to a first embodiment. FIG. 1 illustrates a closed state; and FIG. 2 illustrates an open state. FIG. 3 is a block diagram illustrating aspects related to a hardware configuration of the mobile printer 1.

As illustrated, the mobile printer 1 includes a first housing 11, a second housing 12, a hinge 13, a turning member 14, a head 15, a position detection sensor 16, a printing medium confirmation sensor 17 (confirmation sensor 17), an input unit 18, and a control device 20. In the mobile printer 1, a printing medium is held between the first housing 11 and the second housing 12. The printing medium and the mobile printer 1 move relative to each other, and accordingly, images such as text or symbols can be printed on the printing medium by the head 15. It may be preferable that the sizes of the first housing 11 and the second housing 12 be set such that the mobile printer 1 can be operated by the user holding the mobile printer 1 in one hand while gripping the printing medium with the other hand.

The first housing 11 has a surface that supports the printing medium. As a specific example, the first housing 11 includes a printing medium holding unit 111 (holding unit 111) and a first hinge unit 112 that forms the hinge 13. The holding unit 111 has a flat surface that supports the printing medium. The holding unit 111 has, for example, a rectangular square shape that is longer in one direction than the other. The surface of the holding unit 111 facing the second housing 12 provides a surface that supports the printing medium for printing purposes.

The second housing 12 has a surface on which at least a part of the head 15 is disposed. The second housing 12 rotates relative to the first housing 11. As one example, the second housing 12 includes a head holding unit 121 and a second hinge unit 122. The second hinge unit forms part of the hinge 13. The head holding unit 121 is formed, for example, in a rectangular square shape that is longer in one direction than the other. In the head holding unit 121, a part of the head 15 is disposed on the surface facing the holding unit 111 of the first housing 11. The second housing 12 is configured, together with the holding unit 111, to sandwich and hold the printing medium therebetween.

The hinge 13 is formed such that the first housing 11 and the second housing 12 are turnable within a predetermined angle range around a single shaft. Here, the predetermined angle range goes from a closed position to an open position. The closed position is a position where the first housing 11 and the second housing 12 face each other and are in a sufficiently close state to permit printing to be performed on the printing medium. At the open position, the first housing 11 and the second housing 12 are separated from each other at least sufficiently to permit insertion of the print medium or the like.

The hinge 13 in this example includes a first hinge unit 112, a second hinge unit 122, and a shaft 131. The first hinge unit 112 is formed at one end portion of the first housing 11. The second hinge unit 122 is formed at one end portion of the second housing 12 The shaft 131 extends through the first hinge unit 112 and the second hinge unit 122 and is thus supported in a manner permitting at least one of the first housing 11 and the second housing 12 to pivot thereabout. In some examples, shaft 131 may be integrated with one of the first hinge unit 112 and the second hinge unit 122.

The turning member 14 operates to swing at least one of the first housing 11 and the second housing 12 in a turning direction about the shaft 131. For example, the turning member 14 is a motor. In the present embodiment, the turning member 14 is a motor 141. In other examples, the turning member 14 may be a lever, a system of gears, or the like. In the present example, the motor 141 is driven such that the first housing 11 and the second housing 12 open and close by rotating about the shaft 131. For example, the motor 141 has a rotation shaft and a transmission mechanism that transmits the rotation of the rotation shaft to cause relative movement of the first housing 11 and the second housing 12.

The head 15 includes, for example, an ink tank, an actuator such as a piezoelectric element, a flow path for supplying ink from the ink tank to the actuator, and a nozzle for discharging ink. The head 15 is, for example, an ink jet head. The head 15 is controlled by the control device 20 to discharge ink from the nozzle based on arbitrary image information (print data) provided in any manner.

The head 15 is, for example, a cartridge in which the ink tank, the actuator, the flow path, and the nozzle are integrated. The head 15 is formed to be attachable to and detachable from the head holding unit 121. When the head 15 is attached to the head holding unit 121, the nozzle will be disposed on the surface of the head holding unit 121 facing the first housing 11.

As the ink, in general, any ink type may be utilized. In some examples, the ink may be a deteriorating ink becomes less visible upon exposure to heat, UV light, or the like. In the present embodiment, the deteriorating ink is a decolorable ink that is decolored by heat. Therefore, the head 15 in the present embodiment prints visual information (e.g., text or symbols) with the decolorable ink that can be considered temporary since the printed information can be subsequently decolored/deteriorated by heat to become substantially invisible to the unaided human eye. The print medium can be reusable (printed with other visual information) after the previous visual information is decolored/deteriorated by heat. The temporary visual information may include, for example, the price or other information written on the price tag of a product to be sold at a retail store.

Decoloring in this context includes a case where a printed ink color changes from a specific color to transparent or to another distinct color. In other examples, the ink need not be a decoloring or visually deteriorating ink.

The position detection sensor 16 detects at least one of the closed position and the open position for the first housing 11 and the second housing 12, and outputs the detected information as a signal to the control device 20. As a specific example, the position detection sensor 16 is provided in the first housing 11, detects when the second housing 12 is in the closed position, outputs a signal to the control device 20 indicating the closed position, but outputs no signal if the second housing 12 is not in the closed position. As another specific example, the position detection sensor 16 detects when the second housing 12 is in the closed position and when the second housing 12 is in the open position, and outputs different signals to the control device 20 corresponding to detection of the closed position and the open position. The control device 20 determines whether the first housing 11 and the second housing 12 are in the closed position or in the open position based on the signal(s) output from the position detection sensor 16. For example, the position detection sensor 16 is provided on the surface of the holding unit 111 of the first housing 11 facing the second housing 12 and at the end portion opposite from the first hinge unit 112.

The confirmation sensor 17 detects whether or not the printing medium has been set in the holding unit 111, and outputs the detected information as a signal to the control device 20. As a specific example, the confirmation sensor 17 detects the presence of the printing medium between the holding unit 111 and the head 15, outputs a signal to the control device 20, but outputs no signal if the printing medium is not in the holding unit 111. The control device 20 determines a setting state of the printing medium in the holding unit 111 based on the signal output from the confirmation sensor 17. For example, the confirmation sensor 17 is disposed on a surface of the holding unit 111 facing the second housing 12 and is capable of detecting the printing medium in the holding unit 111 at a position where the printing medium will be disposed at the start of the printing.

The input unit 18 outputs a signal to the control device 20 based on a command or commands input by the user of the mobile printer 1. The input unit 18 is, for example, a button, a sensor, a touch panel, or the like. The input unit 18 receives the input of the user for making selections or performing various functions. For example, the user input pertains to various user-selectable settings and various user commands. The input unit 18 outputs a signal to the control device 20 based on the received user input.

In the present example, the input unit 18 includes a power input unit 181 for inputting a command for turning the power of the mobile printer 1 on and off, an opening and closing input unit 182 for inputting a command for opening or closing the first housing 11 and the second housing 12, and a print input unit 183 for inputting a command for starting printing. The power input unit 181, the opening and closing input unit 182, and the print input unit 183, which are each examples of the input unit 18, may be a button, a sensor, or a touch panel.

The input unit 18 can be positioned such that it can be accessed and/or manipulated by a user that is holding at least one of the first housing 11 and the second housing 12 with one hand. For example, each of the input units 181, 182, and 183 is arranged at suitable positions on the second housing 12 such that a user can perform input with the same hand that is holding the second housing 12. For example, the power input unit 181 and the print input unit 183 are arranged on the main surface of the second housing 12 facing away from the first housing 11. For example, the opening and closing input unit 182 is disposed on a side surface of the second housing 12.

As illustrated in FIG. 3, the control device 20 includes, for example, an interface (I/F) 21, a battery 22, a control circuit 23, a head driving circuit 24, a first memory 25, and a second memory 26, and a processor 27.

The interface 21 is a connection terminal or a communication circuit to which an external apparatus can be communicatively connected. The interface 21 is a communication unit permitting communicating with the external apparatus. Therefore, the interface 21 may be any type of communication interface that can be connected to the external apparatus by wire or by using wireless communication technology such as Bluetooth® or Wi-Fi communication. The interface 21 receives various information, such as image data, from the external terminal or an operation signal for the head 15 corresponding to image data.

The battery 22 is a power supply device. The battery 22 is, for example, a secondary battery. The battery 22 may include a charging circuit for charging the secondary battery.

The control circuit 23 is a processing circuit. The control circuit 23 is connected to the motor 141, the position detection sensor 16, the confirmation sensor 17, and the input unit 18. For example, the control circuit 23 drives the motor 141 based on a control program or the like. The control circuit 23 receives a signal including the position information output from the position detection sensor 16 and a signal including the printing medium confirmation information output from the confirmation sensor 17, and transmits the signals to the processor 27.

The head driving circuit 24 is a processing circuit. The head driving circuit 24 outputs various signals for driving and controlling the head 15 under the control of the processor (CPU) 27.

The first memory 25 stores a program and data used by the program. The first memory 25 also stores image data used for printing. The first memory 25 is, for example, a non-volatile memory. For example, the first memory 25 is a read only memory (ROM).

The second memory 26 stores temporary data. The second memory 26 stores various information such as image data received from the external terminal or the like via the interface 21 or an operation signal of the head 15 corresponding to the image data. The second memory 26 is, for example, a non-volatile memory. For example, the second memory 26 is a random access memory (RAM).

The first memory 25 and the second memory 26 are not limited to the above-described examples. For example, as the first memory 25 and the second memory 26, Electrically Erasable Programmable Read-Only Memory) (EEPROM®), NAND flash memory, a solid-state drive (SSD) equipped with flash memory, or the like can be appropriately selected. The total number and size of memories can also be set as appropriate.

The processor 27 executes arithmetic processing. The processor 27 includes, for example, a processing circuit and a memory. The processor 27 performs various processing based on, for example, a program stored in the first memory 25 or data used in the program, or data such as image data or operation signal stored in the second memory 26. The processor 27 may be configured to acquire a program from the first memory 25 upon the power being turned on (initialization), store the acquired program in the memory, and execute the program stored in the memory.

The processor 27 comprises, for example, a central processing unit (CPU). The processor 27 controls the control circuit 23 and the head driving circuit 24 of the mobile printer 1 in order to realize various functions of the mobile printer 1 according to an operating system and/or an application program.

For example, the processor 27 determines that the first housing 11 and the second housing 12 are in the closed position based on the signal output from the position detection sensor 16. The processor 27 determines that the printing medium has been set in the holding unit 111 based on the signal output from the confirmation sensor 17.

The processor 27 controls the head driving circuit 24 based on the detected positions of the first housing 11 and the second housing 12, the setting status of the printing medium, the input of the user to the input unit 18, the programs stored in the first memory 25 and the second memory 26, the set parameter values, the image data, and the like.

Figure 4:
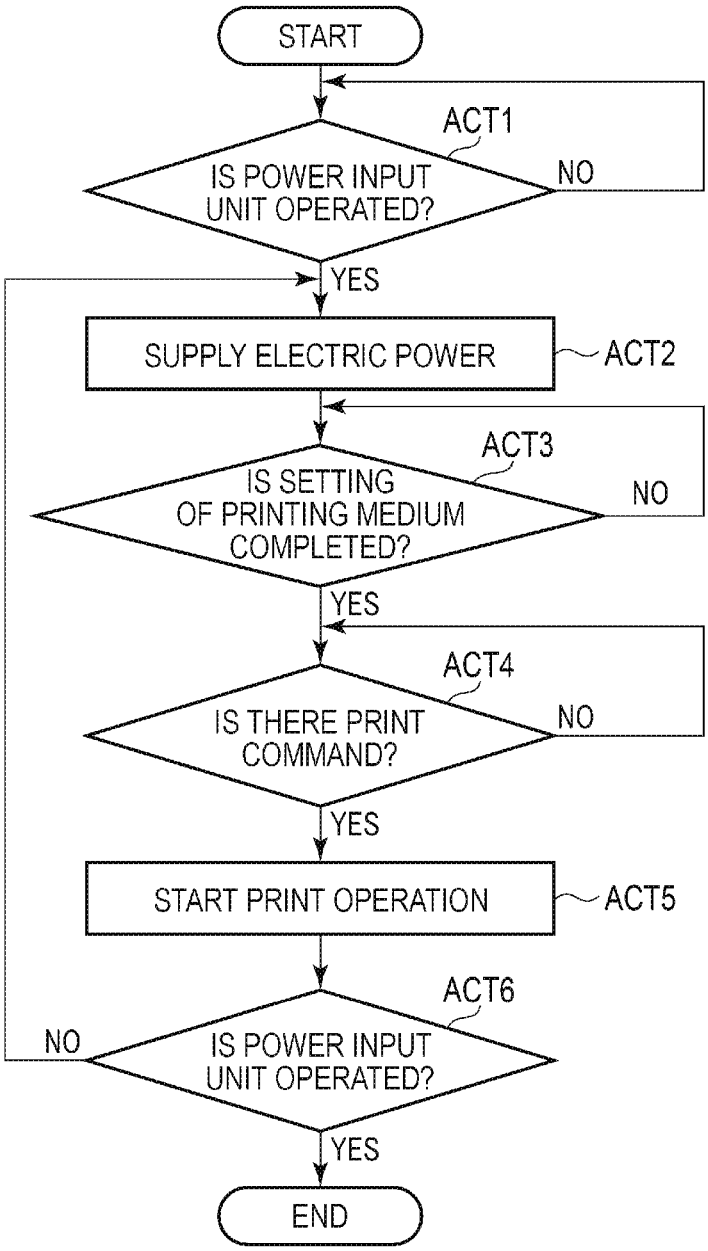
FIG. 4 is a flow chart illustrating an example of operation of a mobile printer according to an embodiment.

Next, an example of printing operations using the mobile printer 1 of the first embodiment will be described with reference to the flow chart illustrated in FIG. 4.

First, the processor 27 detects the operating state of the power input unit 181 (ACT 1). The processor 27 determines whether or not a command for turning on the power has been input from the power input unit 181 by the user based on the signal output from the power input unit 181. If there is no signal output from the power input unit 181 (NO in ACT 1), the processor 27 waits until the command for turning on the power is input from the power input unit 181 (ACT 1). Then, once the power input unit 181 is operated and a signal output from the power input unit 181 is received (YES in ACT 1), the processor 27 supplies the electric power of the battery 22 to the control circuit 23 and the head driving circuit 24 (ACT 2).

Next, the processor 27 determines whether or not the setting of the printing medium is completed (ACT 3). In this context, the setting of print medium means that the printing medium is disposed in the holding unit 111, and the first housing 11 and the second housing 12 are in the closed position.

The processor 27 determines the positions of the first housing 11 and the second housing 12 based on a signal output from the position detection sensor 16, and also determines the setting status of the printing medium based on a signal from the confirmation sensor 17.

For example, if the positions of the first housing 11 and the second housing 12 are still in the open position or the printing medium is not yet disposed in the holding unit 111, the processor 27 determines that the setting of the printing medium is not completed based on the corresponding signals from the position detection sensor 16 and the confirmation sensor 17 (NO in ACT 3). Then, the processor 27 continues to check whether or not the setting of the printing medium has been completed until finally the first housing 11 and the second housing 12 are closed and the printing medium is in the holding unit 111 (ACT 3). For example, if the setting of the printing medium is not completed, the user operates the opening and closing input unit 182 such that the first housing 11 and the second housing 12 are in the open position, and sets the printing medium in the holding unit 111. After this, if the user operates the opening and closing input unit 182 again, the first housing 11 and the second housing 12 are in a closed state.

If the positions of the first housing 11 and the second housing 12 are in the closed position and the printing medium is disposed in the holding unit 111, the processor 27 determines that the setting of the printing medium is completed based on the signals of the position detection sensor 16 and the confirmation sensor 17 (YES in ACT 3).

Accordingly, the processor 27 determines that printing is in a print standby state from which the printing can be started. Next, the processor 27 determines whether or not a command for printing has been sent from the print input unit 183 (ACT 4). In this example, processor 27 determines whether or not a print start signal is output from the print input unit 183. If no signal is output from the print input unit 183 (NO in ACT 4), the processor 27 continues to check for the printing command (ACT 4).

Once a signal is output from the print input unit 183 (YES in ACT 4), the processor 27 controls the head driving circuit 24 and starts a print operation (ACT 5). At this time, the user moves the printing medium in a predetermined direction to print the image data on the printing medium as it moves in the predetermined direction.

After the printing operation is ended, the processor 27 detects the state of the power input unit 181 (ACT 6). In this example, the user turns off the power using the power input unit 181 and this functions as a print end command. The processor 27 determines whether or not a command for turning off the power is received from the power input unit 181 based on the signal output from the power input unit 181. When the command for turning off the power is input via the power input unit 181, the corresponding signal will be output from the power input unit 181 and received (YES in ACT 6), the processor 27 stops supply of the electric power to the control circuit 23 and the head driving circuit 24 at the end of the printing.

If the power input unit 181 does not signal a power off state, the processor 27 returns to ACT 2 and maintains the supply of the electric power to the control circuit 23 and the head driving circuit 24, and then repeats ACT 3 (and subsequent processes as appropriate) in the manner described above.

According to the mobile printer 1 configured in this manner, when the printing medium is held by the holding unit 111, printing can be performed by discharging ink from the head 15. In other words, since the printing medium can be held by the holding unit 111, the mobile printer 1 does not require placing of the printing medium on a flat surface for printing. Accordingly, the mobile printer 1 can perform printing on the printing medium with high printing quality even in a case of a printing medium being a material that would be deformed when force is applied.

In the mobile printer 1, the shapes of the first housing 11 and the second housing 12 are shapes that can be operated with one hand, and the input unit 18 is disposed at a position where the input unit 18 can be operated by the hand that grips the first housing 11 and the second housing 12. With this configuration, in the mobile printer 1, by the operation with one hand, the first housing 11 and the second housing 12 can be gripped and the input unit 18 can be operated. Accordingly, a user of the mobile printer 1 can turn the power on and off, open and close the first housing 11 and the second housing 12, and input a printing command with one hand.

The mobile printer 1 discharges ink from the head 15 based on the signal of the print input unit 183 after confirming the setting state of the printing medium by the position detection sensor 16 and the confirmation sensor 17. Accordingly, the mobile printer 1 can prevent ink from being discharged in a state where the printing medium is not set.

The mobile printer 1 can print temporary visual information on the printing medium by using decolorable ink. When the temporary visual information is printed on a price tag or the like using the mobile printer 1, the information printed on the price tag, such as the price, can be rewritten. If temporary visual information is printed, the mobile printer 1 can repeatedly use the same printing medium over and over. Furthermore, a mobile printer 1 of the present example can be used to print information on a price tag that is already attached to merchandise. For example, the price tag can be held by the holding unit 111, and thus, the temporary visual information such as price on the price tag can be easily rewritten.

According to the mobile printer 1 of the above-described embodiment, the printing medium can be held by the holding unit 111.

The configuration of the mobile printer 1 is not limited to the above-described configuration. In some examples, the mobile printer 1 may have just one of the position detection sensor 16 or the confirmation sensor 17. In such a configuration, when the processor 27 determines in the ACT 3 whether or not the setting of the print medium is completed, this can be based on either whether the printing medium is detected as disposed in the holding unit 111 or the first housing 11 and the second housing 12 being detected in the closed position.

In the above-described example, the mobile printer 1 includes the motor 141 as the turning member 14, but the turning member 14 is not limited to the motor 141. For example, the turning member 14 may be or incorporate a spring 142 (FIG. 5) that urges at least one of the first housing or the second housing 12 in a direction toward the open position in which the first housing 11 and the second housing 12 are separated from each other, or, alternatively, in a direction toward the closed position.

Figure 5:
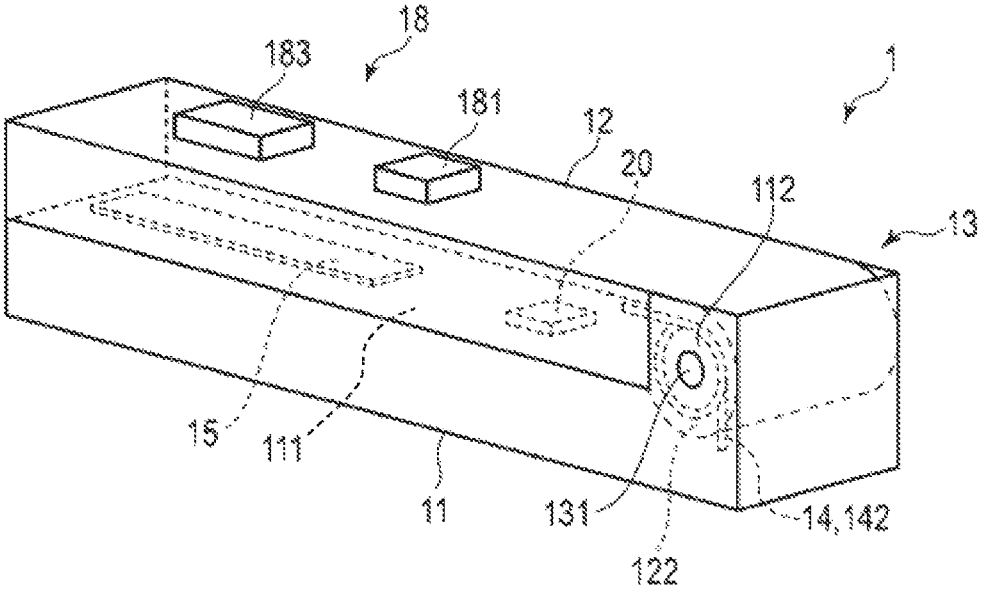
FIG. 5 is a perspective view schematically illustrating aspects of a mobile printer according to another embodiment.
Figure 6:
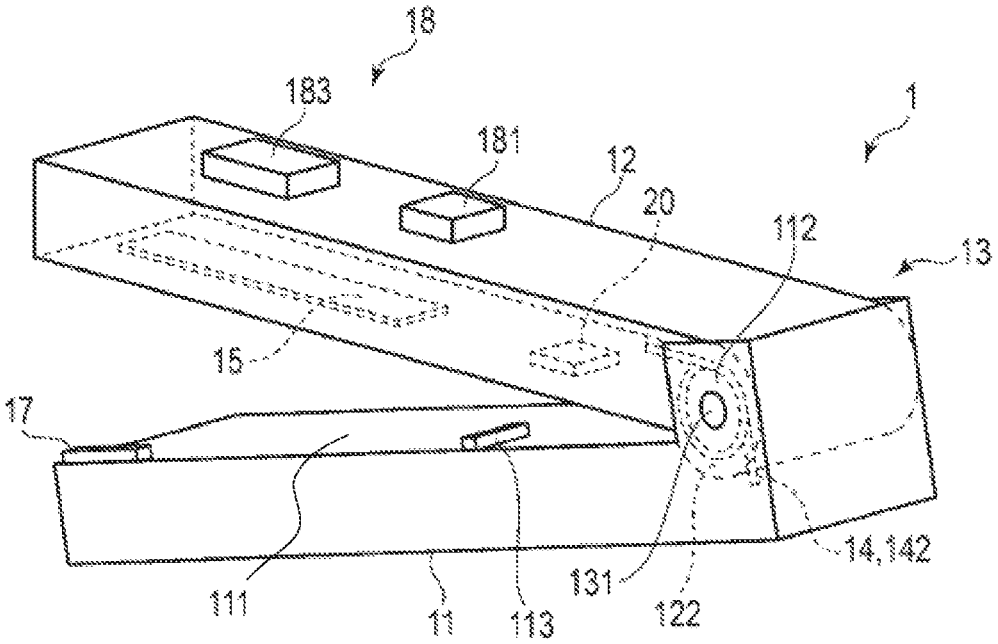
FIG. 6 is a perspective view schematically illustrating additional aspects of a mobile printer according to another embodiment.

FIGS. 5 and 6 illustrate the configuration of the mobile printer 1 including a spring 142 as the turning member 14 or a portion thereof. As illustrated in FIGS. 5 and 6, the mobile printer 1 of this embodiment includes the spring 142. The spring 143 may be referred to as an urging member. As the spring 142, various spring types can be used as long as the first housing 11 and the second housing 12 can be urged to move relative to each other. For example, the spring 142 can be a torsion spring, a coil spring, or the like. The spring 142 urges at least one of the first housing 11 and the second housing 12 such that the first housing 11 and the second housing 12 are in the open position in the relaxed state, for example. Then, when the user grips the first housing 11 and the second housing 12, the first housing 11 and the second housing 12 can be turned to the closed position against the urging action of the spring 142. Since the first housing 11 and the second housing 12 are configured to be selectively turned to the closed position by the user, for example, the mobile printer 1 of this example may be configured to have only the confirmation sensor 17 without the position detection sensor 16 being incorporated. Since the first housing 11 and the second housing 12 are constantly urged in one of the turning directions by the spring 142, the mobile printer 1 does not need to have an opening and closing input unit 182.

The mobile printer 1 of the above embodiments has a configuration in which the printing medium is held by the holding unit 111, and the printing medium is manually moved at the time of printing. The mobile printer 1 may have a configuration in which the printing medium is sandwiched between the first housing 11 and the second housing 12, or may have a configuration in which a spacer is provided in the second housing 12 in order to keep the distance between the printing medium and the nozzle of the head 15 constant. For example, as illustrated in FIG. 6, the holding unit 111 may be provided with a guide 113 for guiding the printing medium along the appropriate moving direction.

The mobile printer 1 was described with an example in which the first housing 11 and the second housing 12 are rotate with respect to one another between the open position and the closed position, but the possible embodiments are not limited thereto. For example, a configuration may be employed in which the first housing 11 and the second housing 12 are entirely separable from one another and printing can be performed on the printing medium using just with the second housing 12 portion of the mobile printer 1. With such a configuration, the position detection sensor 16 and the confirmation sensor 17 may be provided in the second housing 12. This is because, when the first housing 11 and the second housing 12 are separated, it is better to put the electrical components all together in the second housing 12 such that the wirings and the like are not required to be attached and detached between the two separable housing portions. By making the first housing 11 and the second housing 12 separable in this manner, the mobile printer 1 can also perform printing on the printing medium having a size (thickness) that cannot fit between the first housing 11 and the second housing 12.

In other examples, the mobile printer 1 may be configured to permit a large rotation degree between the first housing 11 and the second housing 12, for example 180 degrees or more, without making the first housing 11 and the second housing 12 completely separable. For example, when needing to perform printing on a printing medium that cannot be sandwiched between the first housing 11 and the second housing 12, the first housing 11 and the second housing 12 can be opened to such a degree that the first housing 11 does not interfere with the printing medium. Accordingly, printing can be performed on the printing medium by making only the second housing 12 face the printing medium.

The mobile printer 1 may incorporate a heater for decoloring temporary visual information printed with decolorable ink or the like.

In an above-described example, the processor 27 starts the printing operation if the print input unit 183 is operated, but embodiments are not limited thereto. For example, the processor 27 may initiate the printing operation upon the receipt of print data or the like or automatically upon detection of the appropriate device state.

In an above-described example, the processor 27 determines the setting state of the printing medium based on the signals of the position detection sensor 16 and the confirmation sensor 17, but embodiments are not limited thereto. For example, the processor 27 may be configured to determine the setting state of the printing medium based on a signal from just one of the position detection sensor 16 or the confirmation sensor 17.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A mobile printer, comprising:

a first housing with a first surface;

a second housing with a second surface;

a hinge to connect the first housing and the second housing and configured to permit the first housing and the second housing to rotate relative to each other between a closed position and an open position, the first and second surfaces facing each other in the closed position; and a print head in the second housing at the second surface and configured to print an image on a print medium while the print medium is supported on the first surface and held between the first and second surfaces with first and second housings at the closed position.

2. The mobile printer according to claim 1, further comprising:

a position detection sensor configured to detect relative movement between the first housing and the second housing on the hinge.

3. The mobile printer according to claim 1, further comprising:

a position detection sensor configured to detect when the first housing and the second housing are in the closed position.

4. The mobile printer according to claim 1, further comprising:

a sensor configured to detect that the printing medium is between the first housing and the second housing when the first housing and the second housing are in the closed position.

5. The mobile printer according to claim 1, further comprising:

a motor configured to move at least one of the first housing and the second housing about the hinge in an opening direction in which the first housing and the second housing are separated from each other and a closing direction in which the first housing and the second housing approach each other.

6. The mobile printer according to claim 1, further comprising:

an urging member positioned to move at least one of the first housing and the second housing about the hinge in an opening direction.

7. The mobile printer according to claim 1, wherein the print head is an ink jet type print head.

8. The mobile printer according to claim 1, wherein the hinge is formed of a piece of the first housing and a piece of the second housing connected to one another.

9. The mobile printer according to claim 1, wherein the hinge includes a shaft extending through at least one of the first housing and the second housing.

10. The mobile printer according to claim 1, wherein the first housing can be disconnected from the second housing.

11. The mobile printer according to claim 1, wherein the print head holds decolorable ink therein.

12. The mobile printer according to claim 1, further comprising:

a plurality of user input units on the second housing.

13. A mobile printer, comprising:

a first housing with a first surface;

a second housing with a second surface configured to face the first surface of the first housing; and a print head in the second housing configured to print an image on a print medium supported on the first surface while the print medium is sandwiched between the first and second surfaces in a facing arrangement.

14. The mobile printer according to claim 13, further comprising:

a position sensor configured to detect when the second surface of the second housing is in a position facing the first surface; and a print medium sensor configured to detect when the print medium is between the first and second surfaces in the facing arrangement.

15. The mobile printer according to claim 14, wherein the print head is configured to print an image on the print medium only when both the position sensor detects the second surface is in the position facing the first surface and the print medium sensor detects the print medium is between the first and second surfaces.

16. The mobile printer according to claim 13, wherein the first housing is configured to connect to second housing at a hinge permitting the first housing and the second housing to rotate relative to each other.

17. The mobile printer according to claim 16, further comprising:

a motor configured to move at least one of the first housing and the second housing about the hinge in an opening direction in which the first housing and the second housing are separated from each other and a closing direction in which the first housing and the second housing approach each other.

18. The mobile printer according to claim 16, further comprising:

an urging member positioned to move at least one of the first housing and the second housing about the hinge in an opening direction.

19. The mobile printer according to claim 13, wherein the print head is an ink jet type print head.

20. The mobile printer according to claim 13, wherein the print head holds decolorable ink.

* * * * *